US007573008B2

(12) United States Patent
Yamashita et al.

(10) Patent No.: US 7,573,008 B2
(45) Date of Patent: Aug. 11, 2009

(54) PTC ELEMENT

(75) Inventors: Masaaki Yamashita, Tokyo (JP); Yasuhide Yamashita, Tokyo (JP); Tsuyoshi Sugiyama, Tokyo (JP); Hisanao Tosaka, Tokyo (JP)

(73) Assignee: TDK Corporation, Tokyo (JP)

( * ) Notice: Subject to any disclaimer, the term of this patent is extended or adjusted under 35 U.S.C. 154(b) by 294 days.

(21) Appl. No.: 11/643,962

(22) Filed: Dec. 22, 2006

(65) Prior Publication Data

US 2007/0151968 A1 Jul. 5, 2007

(30) Foreign Application Priority Data

Dec. 28, 2005 (JP) ..... P2005-378925
Feb. 22, 2006 (JP) ..... P2006-045607

(51) Int. Cl.
*H05B 3/10* (2006.01)
*H01C 7/13* (2006.01)

(52) U.S. Cl. ..... 219/553; 219/552; 252/500; 252/512; 252/519.3; 338/22 R; 338/34

(58) Field of Classification Search ..... 219/552–553; 252/500, 512, 519.3; 338/22 R, 34
See application file for complete search history.

(56) References Cited

U.S. PATENT DOCUMENTS 7,314,583 B2 * 1/2008 Mori ..... 252/519.33
2003/0076217 A1 4/2003 Park et al.

FOREIGN PATENT DOCUMENTS

| | | | |
|---|---|---|---|
| JP | B2-4-14701 | | 3/1992 |
| JP | A-7-109434 | | 4/1995 |
| JP | A-07-176837 | | 7/1995 |
| JP | A-07-326691 | | 12/1995 |
| JP | A-11-195507 | | 7/1999 |
| JP | A-2001-181370 | | 7/2001 |
| JP | 2002-164201 | A | 6/2002 |
| JP | A-2002-175903 | | 6/2002 |
| JP | A-2003-124005 | | 4/2003 |
| JP | A-2005-146267 | | 6/2005 |
| WO | WO 2005/070991 | A1 | 8/2005 |

* cited by examiner

*Primary Examiner*—Shawntina Fuqua
(74) *Attorney, Agent, or Firm*—Oliff & Berridge, PLC

(57) ABSTRACT

A PTC element comprising a PTC element body containing a polymer matrix and conductive particles, a pair of electrodes in contact with the PTC element body, and a protective layer composed of a cured epoxy resin composition containing an epoxy resin and a thiol-based curing agent, and covering the PTC element body so as to seal the PTC element body.

8 Claims, 3 Drawing Sheets

PTC ELEMENT

BACKGROUND OF THE INVENTION

1. Field of the Invention

The present invention relates to a PTC (Positive Temperature Coefficient) element.

2. Related Background Art

PTC elements are elements that abruptly increase the positive temperature coefficient of the resistance value when a specified temperature range is reached. As conventional PTC elements there are known PTC elements comprising a matrix resin made of a crystalline polymer (polymer matrix) and a thermistor element body containing a metal powder (Japanese Unexamined Patent Publication No. 2002-164201).

SUMMARY OF THE INVENTION

However, when a conventional PTC element experiences a thermal history after a prolonged period subsequent to manufacture, the PTC element body undergoes deterioration and the room temperature resistance value increases significantly. An increased room temperature resistance value reduces the resistance variation between operation and non-operation, thereby preventing proper functioning of the PTC element.

It is an object of the present invention to provide a PTC element with adequately minimized deterioration of the PTC element body in cases of thermal history after a prolonged period subsequent to manufacture.

The PTC element of the invention comprises a PTC element body containing a resin and conductive particles, a pair of electrodes in contact with the PTC element body, and a protective layer composed of a cured epoxy resin composition containing an epoxy resin and a thiol-based curing agent, and covering the PTC element body so as to seal the PTC element body.

It is believed that when a conventional PTC element experiences a prolonged period subsequent to manufacture, oxygen infiltrates into the PTC element body from the surrounding area. When the PTC element experiences a thermal history in this state, it is believed that the resin and conductive particles in the PTC element body are oxidized by the infiltrated oxygen, and that the oxidation results in deterioration of the PTC element body which causes an increase in the room temperature resistance value. The PTC element of the invention has the PTC element body covered by a protective layer having a specified composition, with no exposure through the outer surface. This reduces infiltration of oxygen into the PTC element body, thereby preventing oxidation of the resin and conductive particles after a thermal history, and minimizing deterioration of the PTC element body due to the thermal history. Based on knowledge of the present inventors, the deterioration of a PTC element body that has experienced a thermal history after a prolonged period is notably inhibited by using as the protective layer a cured epoxy resin composition obtained using a thiol-based curing agent.

The epoxy resin composition which forms a cured protective layer preferably further contains an amine compound. This will further enhance the oxygen barrier property of the protective layer.

The PTC element of the invention may be provided with a PTC element body comprising a polymer matrix and conductive particles, a pair of electrodes in contact with the PTC element body, and a protective layer covering the PTC element body so as to seal the PTC element body, wherein the protective layer comprises a cured layer formed by reacting an epoxy resin with a thiol-based curing agent, and a filler composed of a material with lower oxygen permeability than the cured layer and dispersed in the cured layer. The filler is preferably an inorganic filler.

Based on knowledge of the present inventors, if a PTC element body is protected with a protective layer comprising a cured layer formed using a thiol-based curing agent and a filler composed of a material with lower oxygen permeability than the layer, deterioration of the PTC element body is further inhibited when it experiences a thermal history after a prolonged period.

At least a portion of the filler is preferably lamellar. This will more notably exhibit an effect of inhibiting deterioration of the PTC element body of the invention.

The protective layer preferably contains the filler at 5 to 50 wt % based on the weight of the entire protective layer. If the filler proportion is less than 5 wt %, the effect of inhibiting deterioration of the PTC element body of the invention will tend to be reduced, while if it exceeds 50 wt %, adhesion of the protective layer for the PTC element body and electrodes will tend to be reduced.

The protective layer is preferably formed integrally so as to cover the PTC element body while also covering at least a section of the pair of electrodes.

In this case, if the protective layer is formed straddling the electrodes and the PTC element body, infiltration of oxygen through the interface between the electrodes and the PTC element body is inhibited, for a more notable effect of preventing deterioration of the PTC element body. Furthermore, by forming the protective layer using a thiol-based curing agent, adhesiveness with the electrodes is satisfactory so that an effect is exhibited of preventing peeling of the electrodes from the PTC element body.

DESCRIPTION OF THE PREFERRED EMBODIMENTS

Preferred modes of the invention will now be described in detail. However, the present invention is not limited to the embodiments described below.

Figure 1:
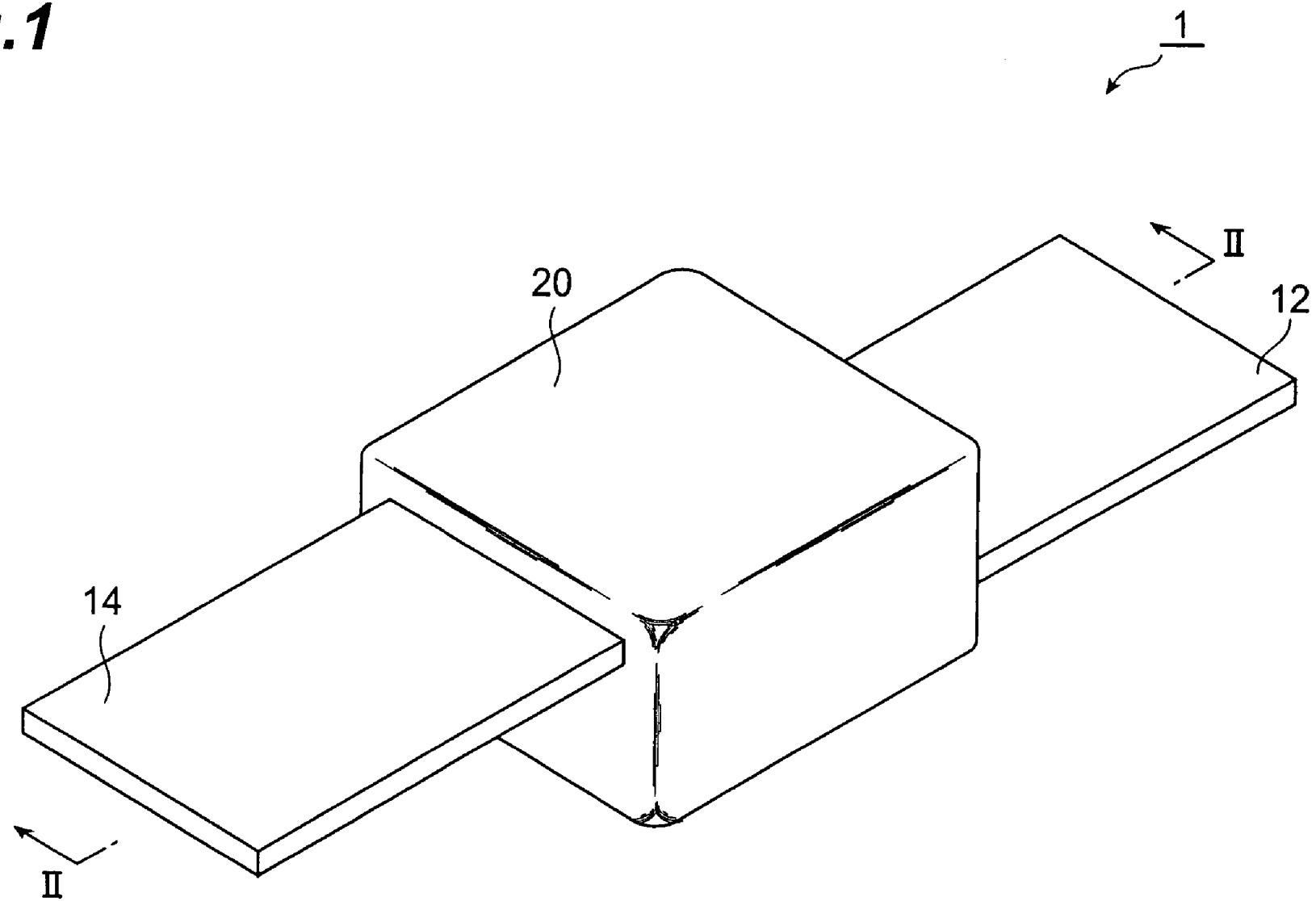
FIG. 1 is a perspective view showing an embodiment of a PTC element according to the invention.
Figure 2:
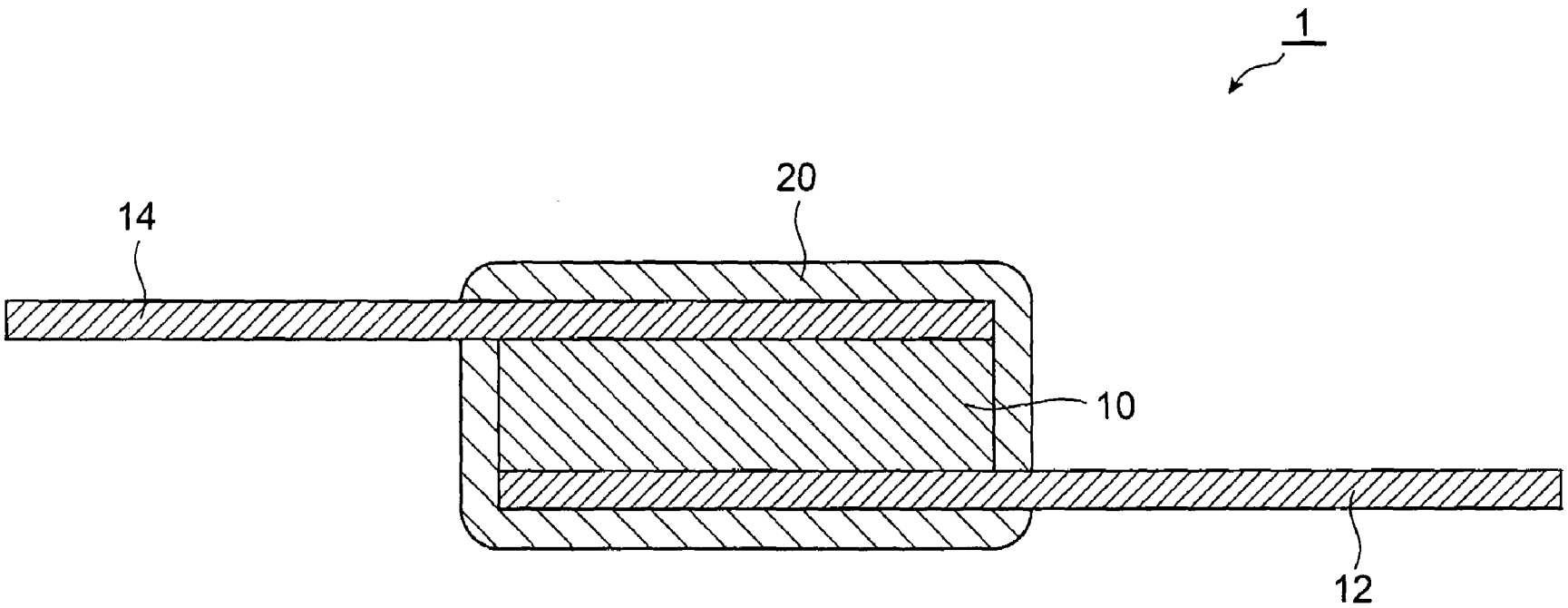
FIG. 2 is a cross-sectional view of FIG. 1 along line II-II.

FIG. 1 is a perspective view showing an embodiment of a PTC element according to the invention, and FIG. 2 is a cross-sectional view of FIG. 1 along line II-II. The PTC element 1 shown in FIGS. 1 and 2 is a polymer PTC element, constructed of a PTC element body 10, a pair of electrodes 12,14 which are opposing and contacting with the PTC element body 10, and a protective layer 20 which covers the PTC element body 10 in such a manner that the PTC element body 10 is sealed.

The protective layer 20 covers the portions of the surface of the PTC element body 10 other than those portions in contact with the pair of electrodes 12,14. Thus, the PTC element body 10 is covered in such a manner that its surface is not exposed. Also, the protective layer 20 is formed integrally so as to cover the surface of the PTC element body 10 while also covering the surfaces of the pair of electrodes 12,14 partially. By forming the protective layer 20 in this manner straddling the electrodes 12,14 and the PTC element body 10 surface, infiltration of oxygen from the interface between the electrodes 12,14 and the PTC element body 10 is inhibited, and the effect of preventing deterioration of the PTC element body 10 is more notably exhibited.

The protective layer 20 is formed of a cured epoxy resin composition containing an epoxy resin and a thiol-based curing agent. The thickness of the protective layer 20 at the portions contacting with the PTC element body 10 is preferably 5 to 500 μm.

As epoxy resins in the epoxy resin composition forming the cured protective layer 20 there may be used epoxy resins obtained by a single-stage process, two-stage process, oxidation process or the like, with no particular restrictions, but there are preferred glycidyl ethers of aromatic amines, or epoxy resins having polar groups or generating polar groups during curing. Specific examples of preferred epoxy resins include bisphenol A-type epoxy resins and bisphenol F-type epoxy resins, glycidylated aliphatic amines, glycidylated aromatic amines such as tetraglycidyl m-xylenediamine and tetraglycidyldiaminodiphenylmethane, and aminophenol-type epoxy resins.

As thiol-based curing agents there may be used thiol compounds having two or more thiol groups, with no particular restrictions. Specific examples of preferred thiol-based curing agents include aliphatic polythioesters such as pentaerythritol tetrathioglycolate and trimethylolpropane tristhiopropionate, aliphatic polythioethers, and aromatic-ring-containing polythioethers. The amount of the thiol-based curing agent in the epoxy resin composition may be appropriately determined in consideration of the equivalent ratio with the epoxy resin, as appreciated by a person skilled in the art.

The epoxy resin composition used to form the protective layer 20 preferably further contains an amine compound with a secondary amino group or tertiary amino group. As such amine compounds there are preferably used aromatic amines, aliphatic amines, amine-epoxy adducts, imidazoles, imidazole adducts and the like.

The epoxy resin composition may also contain other components, including fillers such as silica, mica, talc particles and the like, inorganic salts such as magnesium hydroxide and aluminum hydroxide, other curing agents or curing accelerators such as carboxylic acids or phenols, and solvents intended to adjust the viscosity of the resin composition.

Figure 3:
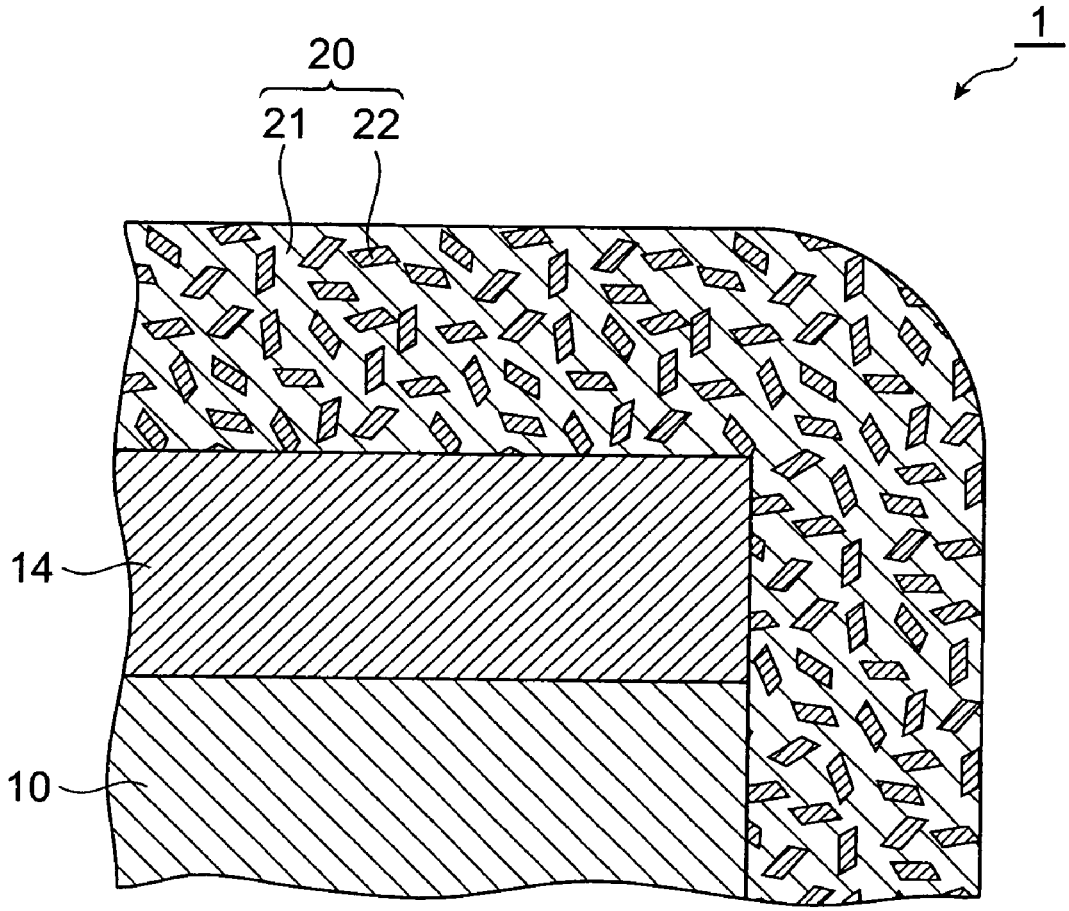
FIG. 3 is a magnified cross-sectional view of a portion of FIG. 2.

FIG. 3 is a magnified cross-sectional view showing a portion of FIG. 2 for an epoxy resin composition containing a filler. The protective layer 20 is constructed of a cured layer 21 formed by reacting an epoxy resin with a thiol-based curing agent, and a lamellar filler 22 dispersed in the cured layer 21.

The cured layer 21 is a polymer matrix composed mainly of a crosslinked polymer formed by reacting an epoxy resin and a thiol-based curing agent. By forming the cured layer 21 of the protective layer 20 using a thiol-based curing agent, an effect is exhibited wherein adhesiveness between the electrodes 12,14 is satisfactory and peeling of the electrodes 12,14 from the PTC element body 10 is prevented.

The protective layer 20 is formed, for example, by heating an epoxy resin composition containing an epoxy resin, thiol-based curing agent and filler to promote reaction (curing reaction) between the epoxy resin and the thiol-based curing agent. When forming the cured layer 21, other curing agents in addition to the thiol-based curing agent may also be reacted with the epoxy resin.

The filler 22 used is one consisted of a material with lower oxygen permeability than the cured layer 21. The filler 22 may be an inorganic filler such as mica, silica, talc, clay (natural or synthetic smectite or other mixtures and the like), glass, aluminum hydroxide, magnesium hydroxide or ceramic, a metal filler such as silver powder, gold powder, copper powder or nickel powder, or an organic filler such as carbon or polyimide. Preferred among these for use as the filler 22 are inorganic fillers containing one or more materials selected from the group consisting of mica, silica, talc, clay, glass, aluminum hydroxide, magnesium hydroxide and ceramics. Inorganic fillers containing such materials have a greater effect of blocking oxygen permeation and are generally insulative, and therefore have the advantage of maintaining insulation between the electrodes 12,14.

The filler 22 of this embodiment is lamellar. This can provide a higher oxygen gas barrier property with a lower amount of addition. Mica is preferred for use as a lamellar filler. However, a spherical, filamentous or amorphous filler may be used instead of a lamellar filler 22. Also, two or more fillers with different shapes may be used in combination.

The protective layer 20 preferably contains the filler 22 at 5 to 50 wt % based on the weight of the entire protective layer 20. The proportion of the filler 22 is more preferably at least 10 wt % and more preferably no greater than 20 wt %. A low proportion of filler 22 will tend to reduce the effect of inhibiting deterioration of the PTC element body 10, while a high proportion of filler 22 will tend to lower the adhesiveness of the protective layer 20 with the PTC element body 10 and the electrodes 12,14. Also, a high proportion of filler 22 increases the viscosity of the epoxy resin composition used to form the protective layer 20, tending to hamper coating of the epoxy resin composition and formation of the protective layer 20.

In the PTC element body 10, the conductive particles are dispersed in the polymer matrix. The polymer matrix may be a thermoplastic resin or a cured thermosetting resin, but the effect of the invention is more notably exhibited if it is a crystalline or amorphous thermoplastic resin. Throughout the present specification, the term "thermoplastic resin" includes thermoplastic resins having crosslinked polymer chains.

In order to prevent flowing of the low-molecular organic compound due to melting or deformation of the PTC element body 10 during operation when the PTC element body 10 comprises a low-molecular organic compound as described hereunder, the melting point or softening point of the thermoplastic resin is preferably higher than the melting point of the low-molecular compound, more preferably it is at least 30° C. higher, and even more preferably it is in a range of at least 30° C. and no more than 110° C. higher. The melting point or softening point of the thermoplastic resin is preferably 70° C. to 200° C.

The molecular weight of the thermoplastic resin is preferably between about 10000 and 5 million as the weight-average molecular weight Mw. The melt flow rate of the thermoplastic resin as defined by ASTMD1238 is preferably 0.1 to 30 g/10 minutes.

As thermoplastic resins to be suitably applied as the polymer matrix there may be mentioned polyolefins (for example, polyethylene), copolymers of one or more different olefins (for example, ethylene or propylene) with one or more different olefmic unsaturated monomers containing a polar group (for example, ethylene-vinyl acetate copolymer), polyhalogenated vinyl or polyhalogenated vinylidenes (for example, polyvinyl chloride, polyvinylidene chloride, polyvinyl fluoride, polyvinylidene fluoride), polyamides (for example, 12-nylon), polystyrene, polyacrylonitrile, thermoplastic elastomers, polyethylene oxide, polyacetals, thermoplastic-modified cellulose, polysulfones, polymethyl (meth)acrylate and the like. Polyolefins are preferred among these, and polyethylene is particularly preferred among polyolefins.

As more specific examples of thermoplastic resins there may be mentioned high-density polyethylene (for example, "HIZEX 2100JP" (trade name of Mitsui Petroleum Chemical Co., Ltd.) and "Marlex 6003" (trade name of Philips Corp.)), low-density polyethylene (for example, LC500 (trade name of Nippon Polychem Co., Ltd. and "DYNH-1" (trade name of Union Carbide Corp.)), medium-density polyethylene (for example, "2604M" (trade name of Gulf Oil Corp.)), ethylene-ethyl acrylate copolymer (for example, "DPD 6169" (trade name of Union Carbide Corp.)), ethylene-acrylic acid copolymer (for example, "EAA 455" (trade name of Dow Chemical Co.)), hexafluoroethylene-tetrafluoroethylene copolymer (for example, "FEP 100" (trade name of DuPont Corp.)) and polyvinylidene fluoride (for example "Kynar 461", (trade name of Pennwalt Corp.)).

These thermoplastic resins may be used alone or in combinations of two or more. Although it is preferable for the polymer matrix to be composed only of a thermoplastic resin, the polymer matrix may optionally contain elastomers or cured thermosetting resins, or mixtures thereof.

The conductive particles are not particularly restricted so long as a PTC characteristic is exhibited in combination with the polymer matrix, but Ni is particularly preferred as the material. When Ni particles are used, the PTC element body will be prone to deterioration by oxidation, in which case this embodiment introducing a protective layer 20 is especially useful.

The conductive particles preferably have spiky protuberances. Conductive particles having spiky protuberances are conductive particles having a plurality of spiky protuberances (usually 10 to 500) formed on the surfaces (typically protuberances with heights of ⅓ to 1/50 of the particle diameters).

The conductive particles may be in the form of a powder with discrete primary particles, but preferably the primary particles are in chains of about 10 to 1000, forming secondary particles. An example of the former is spherical Ni particles having spiky protuberances, marketed as "INCO Type 123 nickel powder" (trade name of Inco Co., Ltd.). The mean particle size of the Ni particles is about 3 to 7 μm, the apparent density is about 1.8 to 2.7 g/cm$^3$ and the area-to-weight ratio is about 0.34 to 0.44 m$^2$/g.

Examples of Ni particles having chains of secondary particles formed include the filamentous Ni particles marketed as "INCO Type 255 nickel powder", "INCO Type 270 nickel powder", "INCO Type 287 nickel powder" and "INCO Type 210 nickel powder" (all trade names of Inco Co., Ltd.). Preferred among these are INCO Types 255, 277 and 287. The apparent density of these filamentous Ni particles is about 0.3 to 1.0 g/cm$^3$, and the area-to-weight ratio is about 0.4 to 2.5 m$^2$/g.

The mean particle size of the primary particles of the filamentous Ni particles (the value measured by the Fischer subsieve method) is preferably 0.1 μm or greater, more preferably at least 0.5 μm and no greater than 4.0 μm, and even more preferably at least 1.0 μm and no greater than 4.0 μm. Also, filamentous Ni particles having a primary particle mean particle size of at least 1.0 μm and no greater than 4.0 μm may be combined with filamentous Ni particles having a primary particle mean particle size of at least 0.1 μm and less than 1.0 μm, in a proportion of no greater than 50 wt % of the latter with respect to the total conductive particles.

The conductive particle content of the thermistor element body 10 may be appropriately determined for expression of the PTC characteristic. Specifically, the conductive particle content is preferably 20 to 50 vol % with respect to the total volume of the thermistor element body 10.

The PTC element body 10 also preferably contains a low-molecular organic compound in addition to the polymer matrix and conductive particles. In this case, the low-molecular organic compound used is preferably a crystalline compound with a molecular weight of no greater than 1000. The low-molecular organic compound is preferably a solid at ordinary temperature (about 25° C.). Also, the low-molecular organic compound preferably has a melting point (mp) of 40 to 100° C.

As preferred examples of low-molecular organic compounds there may be mentioned hydrocarbons (for example, C22 or greater alkane straight-chain hydrocarbons), fatty acids (for example, C22 or greater alkane straight-chain hydrocarbon fatty acids), fatty acid esters (for example, saturated fatty acid methyl esters obtained from C20 or greater saturated fatty acids and lower alcohols such as methyl alcohol), fatty acid amides (for example, up to C10 saturated fatty acid primary amides or unsaturated fatty acid amides such as oleic acid amide or erucic acid amide), aliphatic amines (for example, C16 or greater aliphatic primary amines), and higher alcohols (specifically, C16 or greater n-alkyl alcohols). The low-molecular organic compound may be used alone or in an appropriate combination of two or more, depending on the operating temperature, etc. The low-molecular organic compound may also be used in the state of a wax or oil containing it as a component.

As waxes containing low-molecular organic compounds there may be mentioned petroleum-based waxes such as paraffin wax and microcrystalline wax, as well as natural waxes such as vegetable waxes, animal waxes and mineral waxes. As fats and oils containing low-molecular organic compounds there may be mentioned fats, and so-called "solid fats".

Low-molecular organic compounds or waxes or fats and oils containing them are commercially available. Examples of commercially available paraffin waxes include "tetracosane $C_{24}H_{50}$" (mp: 49 to 52° C.), "hexatriacontane $C_{36}H_{74}$" (mp: 73° C.), "HNP-10" (trade name of Nippon Seiro Co., Ltd., mp: 75° C.), and "HNP-3" (trade name of Nippon Seiro Co., Ltd., mp: 66° C.) Examples of commercially available microcrystalline waxes include "Hi-Mic-1080" (trade name of Nippon Seiro Co., Ltd., mp: 83° C.), "Hi-Mic-1045" (trade name of Nippon Seiro Co., Ltd., mp: 70° C.), "Hi-Mic2045" (trade name of Nippon Seiro Co., Ltd., mp: 64° C.), "Hi-Mic3090" (trade name of Nippon Seiro Co., Ltd., mp: 89° C.), "Seratta 104" (trade name of Nippon Sekiyu Seisei Co., Ltd., mp: 96° C.) and "155 Microwax" (trade name of Nippon Sekiyu Seisei Co., Ltd., mp: 70° C.). Examples of commercially available fatty acids include behenic acid (product of Nippon Seika Co., Ltd., mp: 81° C.), stearic acid (product of Nippon Seika Co., Ltd., mp: 72° C.) and palmitic acid (product of Nippon Seika Co., Ltd., mp: 64° C.). An example of a commercially available fatty acid ester is arachic acid methyl ester (product of Tokyo Chemical Industry Co., Ltd., mp: 48° C.). An example of a commercially available fatty acid amide is oleic amide (product of Nippon Seika Co., Ltd., mp: 76° C.).

The pair of electrodes 12,14 in the PTC element 1 are situated so that portions of each oppose each other. The electrodes 12,13 are made of a conductive material such as a metal, and are formed to a thickness of about 0.1 mm. The conductive material composing the electrodes 12,14 is preferably Ni or a Ni alloy. Preferably, at least part of the surfaces of the electrodes 12,14 in contact with the PTC element body are roughened. Roughening of the surfaces of the electrodes 12,14 will produce an anchoring effect, thereby more firmly anchoring the electrodes 12,14 to the PTC element body 10.

When the polymer matrix in the PTC element body 10 contains a thermoplastic resin, the PTC element 1 may be obtained by, for example, a production process comprising a step of kneading a mixture containing the thermoplastic resin and conductive particles to obtain a kneaded blend containing them, a step of molding the kneaded blend into a sheet to form a PTC element body 10 having the conductive particles dispersed in the polymer matrix containing the thermoplastic resin, a step of fixing the pair of electrodes 12,14 onto the PTC element body 10 by thermocompression bonding, and a step of forming a protective layer 20 covering the PTC element body 10 in such a manner that the PTC element body 10 is sealed.

The step of obtaining the kneaded blend may be carried out while heating the mixture of the components at a temperature above the melting point or softening point (preferably 5 to 40° C. higher than the melting point or softening point) of the thermoplastic resin. Alternatively, kneading of the mixture may be performed after addition of a solvent that dissolves the thermoplastic resin to produce a low viscosity state, thereby allowing dispersion of the conductive particles in the thermoplastic resin without heating. The kneading may be accomplished by a publicly known process using a mill, pressurized kneader, twin-screw extruder or the like.

The obtained kneaded blend is molded into a sheet by a method such as hot pressing to form the PTC element body 10. At this stage, the PTC element body 10 may be cut out to a prescribed size by punching or the like.

The PTC element body 10 stacked between the pair of electrodes 12,14 is hot pressed to anchor the pair of electrodes 12,14 to the PTC element body 10. After anchoring the electrodes 12,14, the thermoplastic resin in the polymer matrix is preferably crosslinked by irradiation or the like. The crosslinking results in more satisfactory stability of the PTC element 1 to heat.

The protective layer 20 is formed by attaching the epoxy resin composition to the surface of the PTC element body 10 and electrodes 12,14 and heating the attached epoxy resin composition to promote curing reaction (reaction between the epoxy resin and thiol-based curing agent). The method for attaching the epoxy resin composition is not particularly restricted, and may be a dip method, printing method, spray method or the like. The epoxy resin composition may also be dissolved or dispersed in a solvent form for adhesion to the thermistor element body 10, and then the solvent removed by drying. In this case, the drying and curing may be carried out simultaneously or continuously.

The conditions for curing of the epoxy resin composition may be appropriately set depending on the type of thiol-based curing agent and the curing accelerator (tertiary amine, etc.) combined therewith, but preferably the protective layer 20 is formed by heating at a temperature below the operating temperature of the PTC element. If the protective layer 20 is formed by heating at a temperature above the operating temperature, the resistance value of the PTC element when it is restored to ordinary temperature may increase above the resistance value of the PTC element before curing of the epoxy resin. The operating temperature referred to here is the temperature on a resistance-temperature curve, representing the change in resistance value with increasing temperature of the PTC element at a temperature-elevating rate of 2° C./min, at the intersection between the tangent at the section of approximately constant resistance value in a lower temperature range than the region in which the PTC characteristic is exhibited, and the tangent at the section where the resistance value rises abruptly with temperature increase. Specifically, when using an epoxy resin composition employing a thiol-based curing agent, the protective layer 20 is preferably formed by heating at 50 to 90° C. In such cases, the heating time is preferably 5 to 120 minutes.

EXAMPLES

The present invention will now be explained in greater detail by examples. However, the invention is in no way limited to the examples.

Example 1

Filamentous Ni particles were added to low-density polyethylene as the polymer matrix (mp: 122° C., density: 0.92 g/cm$^3$) in an amount for 35 vol % with respect to the total volume of the polymer matrix and Ni particles, and kneading was performed for 30 minutes in a Laboplastomil while heating to 150° C. to obtain a kneaded blend having Ni particles dispersed therein. The obtained kneaded blend was molded into a sheet with a thickness of 0.8 mm using a hot press at 150° C., and cut out to a size of 3×4 mm to obtain a thermistor element body (PTC element body).

Next, the PTC element body was sandwiched between two Ni foils each roughened on one side and the sandwiched laminate was subjected to heating and pressurization with a hot press to anchor the Ni foils as electrodes to the PTC element body. The thermistor element body was then exposed to irradiation for crosslinking of the low-density polyethylene.

An epoxy resin composition containing an epoxy resin and thiol-based curing agent (AE-10TM, base compound/curing agent mixture by Ajinomoto Fine-Techno) was then coated to a thickness of about 20 μm by dipping so as to cover all of the exposed surface of the thermistor element body as well as portions of the Ni foil surfaces. The coated epoxy resin composition was heated at 60° C. for 60 minutes to form a protective layer composed of the cured epoxy resin composition (Tg: 40° C.). A PTC element was fabricated in this manner.

Example 2

To 100 parts by weight of a mixture prepared by adding the thiol-based curing agent pentaerythritol tetrathioglycolate in an equivalent amount to a mixture of 50 parts by weight of a bisphenol A-type epoxy resin ("850" by Dainippon Ink & Chemicals, Inc.) and 50 parts by weight of a bisphenol F-type epoxy resin ("830" by Dainippon Ink & Chemicals, Inc.), there were added 10 parts by weight of an imidazole adduct ("PN-23J" by Ajinomoto Fine-Techno) and 10 parts by weight of silica, and a roll was used for dispersion to prepare an epoxy resin composition. The obtained epoxy resin composition was coated to a thickness of about 20 μm by dipping so as to cover all of the exposed surface of the thermistor element body as well as portions of the Ni foil surfaces, in the same manner as Example 1. The coated epoxy resin composition was heated at 80° C. for 60 minutes to form a protective layer composed of the cured epoxy resin composition (Tg: 55° C.). A PTC element was fabricated in this manner.

Comparative Example 1

A PTC element was fabricated in the same manner as the examples, except that no protective layer was formed.

Comparative Example 2

A PTC element was fabricated in the same manner as Example 1, except that an epoxy resin composition containing an epoxy resin and amine-based curing agent ("MAXIVE", base compound/curing agent mixture by Mitsubishi Gas Chemical Co., Inc.) was used instead of AE-10. The Tg of the protective layer was 106° C.

Example 3

Filamentous Ni particles were added to low-density polyethylene as the polymer matrix (mp: 122° C., density: 0.92 g/cm$^3$) in an amount for 35 vol % with respect to the total volume of the polymer matrix and Ni particles, and kneading was performed for 30 minutes in a Laboplastomil while heating to 150° C. to obtain a kneaded blend having Ni particles dispersed therein. The obtained kneaded blend was molded into a sheet with a thickness of 0.8 mm using a hot press at 150° C., and cut out to a size of 3×4 mm to obtain a PTC element body.

The PTC element body was then sandwiched between two Ni foils each roughened on one side and the sandwiched laminate was subjected to heating and pressurization with a hot press to anchor the Ni foils as electrodes to the PTC element body. Next, the PTC element body was exposed to irradiation for crosslinking of the low-density polyethylene.

An epoxy resin composition containing an epoxy resin and thiol-based curing agent was then coated to a thickness of about 20 μm by dipping so as to cover all of the exposed surface of the PTC element body as well as portions of the Ni foil surfaces To 100 parts by weight of a resin mixture prepared by adding the thiol-based curing agent trimethylolpropane tristhiopropionate in an equivalent amount to a mixture of 50 parts by weight of a bisphenol A-type epoxy resin ("850" by Dainippon Ink & Chemicals, Inc.) and 50 parts by weight of a bisphenol F-type epoxy resin ("830" by Dainippon Ink & Chemicals, Inc.), and further adding an imidazole adduct ("PN-23J" by Ajinomoto Fine-Techno), there was added mica ("A-11" by Yamaguchi Mica Co., Ltd.) in an amount of 5 wt % of the total epoxy resin composition, and a roll was used to prepare a dispersion for use as the epoxy resin composition. The coated epoxy resin composition was heated at 80° C. for 30 minutes to form a protective layer composed of the cured epoxy resin composition. A PTC element was fabricated in this manner.

Example 4

A PTC element was fabricated in the same manner as Example 3, except that the amount of mica was 10 wt % of the total epoxy resin composition.

Example 5

A PTC element was fabricated in the same manner as Example 3, except that the amount of mica was 20 wt % of the total epoxy resin composition.

Example 6

A PTC element was fabricated in the same manner as Example 3, except that the amount of mica was 50 wt % of the total epoxy resin composition.

Example 7

A PTC element was fabricated in the same manner as Example 3, except that silica ("FS-44" by Denki Kagaku Kogyo Co., Ltd.) was used instead of mica, and the amount was 10 wt % of the total epoxy resin composition.

Example 8

A PTC element was fabricated in the same manner as Example 7, except that the amount of silica was 20 wt % of the total epoxy resin composition.

Example 9

A PTC element was fabricated in the same manner as Example 3, except that the protective layer was formed using an epoxy resin composition prepared without addition of a filler (mica).

Reference Example

It was attempted to form a protective layer using an epoxy resin composition prepared in the same manner as Example 3, except that the amount of mica was 60 wt % of the total epoxy resin composition, but because of high viscosity it was not possible to coat the resin by dipping and a PTC element could not be fabricated.

Resistance Value of PTC Element

The fabricated PTC element was heated at a temperature-elevating rate of 2° C./minute and then cooled, and the change in resistance value was measured by the 4-terminal method to obtain a temperature-resistance curve from which the room temperature (25° C.) resistance value was evaluated. Also, the PTC element was allowed to stand at ordinary temperature for 180 days and then heated at 100° C. for 5 hours using a drier, after which the room temperature resistance value was evaluated in the same manner. Upon calculating the temperature for a resistance value of 75Ω from the initial temperature-resistance curve, the temperatures for the thermistor element of both the examples and comparative examples were within a range of 100° C.±8° C., and therefore a PTC characteristic was exhibited for functioning at an operating temperature of below 100° C.

Adhesiveness

The epoxy resin composition used in each example or comparative example was coated onto a Ni foil (electrolytic foil, 25 μm thickness, product of Fukuda Metal Foil & Powder Co., Ltd.) on the s side (drum side of the electrolytic foil) and heated at 60° C. for 60 minutes, to form a resin layer corresponding to a protective layer of the PTC element on the Ni foil. Next, a test piece of the Ni foil on which the resin layer was formed was affixed to a base with the Ni foil facing upward, and the Ni foil was removed so as to leave a 10 mm-wide strip section. The edge of the short side of the Ni foil strip was fixed with tweezers and an autograph was used for peeling in the direction vertical to the main surface of the Ni foil at a speed of 50 mm/min, whereby the peel load was measured. This value was used to evaluate the adhesiveness of the protective layer.

TABLE 1

| | Protective layer | | | Room temperature resistance value (Ω) | |
|---|---|---|---|---|---|
| | Curing agent | Tg (° C.) | Adhesiveness (kgf/cm) | Initial | After ordinary temperature standing + heat treatment |
| Example 1 | Thiol-based curing agent | 40 | 0.7 | 4 | 15 |
| Example 2 | Thiol-based curing agent + imidazole adduct | 55 | 0.5 | 4 | 13 |
| Comp. Ex. 1 | No protective layer | — | — | 3 | 40 |
| Comp. Ex. 2 | Amine-based curing agent | 106 | 0.2 | 4 | 50 |

As shown in Table 1, the PTC element of Comparative Example 1 which had no protective layer and the thermistor element of Comparative Example 2 which had the protective layer formed of an epoxy resin composition with an amine-based curing agent both had notably increased room temperature resistance values upon experiencing a thermal history after standing at ordinary temperature. In contrast, the room temperature resistance value increase was adequately inhibited in the thermistor element of the examples which had protective layers formed of epoxy resin compositions employing thiol-based curing agents. Also, the protective layers of the PTC elements of the examples had distinctly superior Ni foil adhesiveness compared to the protective layer of Comparative Example 2.

TABLE 2

| | Filler | | | | Room temperature resistance value (Ω) | |
|---|---|---|---|---|---|---|
| | Type | Shape | Amount added (wt %) | Adhesiveness (kgf/cm) | Initial | After ordinary temperature standing + heat treatment |
| Example 3 | Mica | Lamellar | 5 | 0.9 | 4 | 13 |
| Example 4 | Mica | Lamellar | 10 | 0.6 | 4 | 11 |
| Example 5 | Mica | Lamellar | 20 | 0.5 | 4 | 8 |
| Example 6 | Mica | Lamellar | 50 | 0.1 | 4 | 6 |
| Example 7 | Silica | Amorphous | 10 | 0.8 | 4 | 13 |
| Example 8 | Silica | Amorphous | 20 | 0.6 | 4 | 11 |
| Example 9 | None | — | 0 | 1.1 | 4 | 18 |
| Comp. Ex. 1 | No protective layer | — | — | — | 3 | 40 |
| Reference Example | Mica | Lamellar | 60 | None | — | — |

As shown in Table 2, the PTC elements of the examples which had the protective layer formed of an epoxy resin composition containing a thiol-based curing agent had inhibited increase in room temperature resistance values upon experiencing a thermal history after standing at ordinary temperature, compared to the thermistor element of Comparative Example 1. Particularly satisfactory adhesiveness was exhibited by the protective layers of the PTC elements of Examples 3 to 5, 7 and 8 which had filler contents in a range of 5 to 20 wt %.

The PTC element of the invention has adequately minimized PTC element body deterioration upon thermal history after a prolonged period subsequent to manufacture. The increase in room temperature resistance value upon thermal history after a prolonged period is also adequately inhibited. Furthermore, the PTC element of the invention has a protective layer with an excellent oxygen barrier property, and is therefore highly resistant to oxidation.

In addition, the protective layer of the PTC element of the invention has excellent adhesiveness with electrodes, and when the protective layer is formed integrally so as to cover the PTC element body while also covering at least a section of the pair of electrodes, peeling between the electrodes and the PTC element body is prevented.

What is claimed is:

1. A PTC element comprising:

a PTC element body containing a polymer matrix and conductive particles;

a pair of electrodes in contact with the PTC element body; and a protective layer composed of a cured epoxy resin composition containing an epoxy resin and a thiol-based curing agent, and covering the PTC element body so as to seal the PTC element body.

2. A PTC element according to claim 1, wherein the epoxy resin composition further contains an amine compound.

3. A PTC element according to claim 1, wherein the protective layer is formed integrally so as to cover the PTC element body while also covering at least part of the pair of electrodes.

4. A PTC element comprising:

a PTC element body containing a polymer matrix and conductive particles;

a pair of electrodes in contact with the PTC element body; and a protective layer covering the PTC element body so as to seal the PTC element body;

wherein the protective layer comprises:

a cured layer formed by reacting an epoxy resin with a thiol-based curing agent; and a filler composed of a material with lower oxygen permeability than the cured layer and dispersed in the cured layer.

5. A PTC element according to claim 4, wherein the filler is an inorganic filler.

6. A PTC element according to claim 4, wherein at least a portion of the filler is lamellar.

7. A PTC element according to claim 4, wherein the protective layer contains the filler at 5 to 50 wt % based on the weight of the entire protective layer.

8. A PTC element according to claim 4, wherein the protective layer is formed integrally so as to cover the PTC element body while also covering at least part of the pair of electrodes.

* * * * *